US005772454A

United States Patent [19]

Long, Jr.

[11] Patent Number: 5,772,454

[45] Date of Patent: Jun. 30, 1998

[54] WIRE TO BOARD CONTACT TERMINAL

[75] Inventor: Kenneth Wade Long, Jr., Winston-Salem, N.C.

[73] Assignee: The Whitaker Corporation, Wilmington, Del.

[21] Appl. No.: 705,504

[22] Filed: Aug. 29, 1996

Related U.S. Application Data

[60] Provisional application No. 60/007,245 Nov. 3, 1995.

[51] Int. Cl.[6] ..... H01R 9/09

[52] U.S. Cl. ..... 439/83; 439/865; 439/877

[58] Field of Search ..... 439/82, 746, 865, 439/866, 867, 868, 872, 948, 83, 877, 882

[56] References Cited

U.S. PATENT DOCUMENTS

| | | | |
|---|---|---|---|
| 3,808,588 | 4/1974 | McGregor | 439/872 |
| 3,953,103 | 4/1976 | Mathis | 439/866 |
| 3,963,316 | 6/1976 | Williams | 439/82 |
| 3,995,931 | 12/1976 | Pienkowski | 439/866 |
| 4,916,804 | 4/1990 | Yoshimura et al. | 439/610 |
| 4,946,408 | 8/1990 | Garrett et al. | 439/872 |

OTHER PUBLICATIONS

*AMP Application Specification 114–1016,* "Miniature AMP–IN Contacts"; six pages; Aug. 1990; AMP Incorporated, Harrisburg, PA.

*Primary Examiner*—Gary F. Paumen
*Assistant Examiner*—Barry M. L. Standig
*Attorney, Agent, or Firm*—Mary K. VanAtten; Anton P. Ness

[57] ABSTRACT

The invention comprises a contact terminal having a body with a forward end, a rearward end, an insulation crimping section, and a conductor crimping section. The body has a first stop member to engage insulation on a wire and prevent the insulation from being inserted further forward into the body. A second stop member engages an upper surface of a circuit board to prevent the body from being inserted further forward into a through hole in the circuit board. The second stop member being further forward on the body than the first stop member. When the body is inserted into the through hole in the circuit board, the first and the second stop members maintain the insulation on the wire spaced away from the circuit board thereby protecting the insulation from exposure to heat during soldering.

18 Claims, 2 Drawing Sheets

WIRE TO BOARD CONTACT TERMINAL

This application claims the benefit of U.S. provisional application Ser. No. 60/007,245, filed Nov. 3, 1995.

FIELD OF THE INVENTION

The invention relates to a contact terminal to provide an electrical connection from a wire to a board, and in particular, to a contact terminal which provides protection for the insulation on the wire during the soldering process.

BACKGROUND OF THE INVENTION

In order to provide electrical connection to a circuit board, a wire can be directly soldered to traces on the board. In order to provide a more mechanically secure connection, a contact terminal can be terminated to the end of the wire. The contact terminal is then inserted into a through hole on the board to temporarily secure the contact and the wire to the board. Solder is then applied on the side of the board opposite to the wire to provide electrical connection to the board and also to secure the contact and the wire to the board.

The contact typically has a wire barrel which is used to crimp to the wire, an insulation barrel which is crimped to the insulation surrounding the wire to provide support and strain relief, and a contact section. The contact may have a latch arm to engage the board. In many applications, the wire barrel, which has been crimped around the wire, is received within the through hole.

One problem which occurs during soldering of the contact terminal to the board is that the insulation can come into contact with the hot solder, or it can become heated because of the soldering process. If the insulation comes into contact with the heat, it can become destroyed. It would be an advantage to have a contact with a stop which prevents the insulation from coming into contact with the hot solder or with the heated board.

SUMMARY OF THE INVENTION

The invention comprises a contact terminal with a body having a forward and a rearward end. The body has an insulation crimping section along the rearward end, a conductor crimping section, and a latch member toward the forward end. A stop arm is disposed along the body between the latch member and the insulation crimping section. The stop arm has a forwardly facing shoulder and a rearwardly facing shoulder. The body is adapted to be crimped to a wire having insulation surrounding a conductor. The rearwardly facing shoulder provides a stop for the insulation so that the insulation is not received into the body forward of the stop arm. The insulation crimping section is adapted to be secured to the insulation and the conductor crimping section being adapted to be crimped to the conductor. The body is received through a hole in a circuit board to provide electrical connection therewith. The circuit board has a first surface and a second surface, the latch member engages the second surface and the forwardly facing shoulder engaging the first surface, thereby positioning the insulation away from the circuit board during soldering to protect the insulation from heat.

The invention further comprises a contact terminal having a body with a forward end, a rearward end, an insulation crimping section, and a conductor crimping section. The body has a first stop member to engage insulation on a wire and prevent the insulation from being inserted further forward into the body. A second stop member engages an upper surface of a circuit board to prevent the body from being inserted further forward into a through hole in the circuit board. The second stop member being further forward on the body than the first stop member. When the body is inserted into the through hole in the circuit board, the first and the second stop members maintain the insulation on the wire spaced away from the circuit board thereby protecting the insulation from exposure to heat during soldering.

BRIEF DESCRIPTION OF THE DRAWINGS

An embodiment of the present invention will now be described by way of example with reference to the accompanying drawings, in which.

DETAILED DESCRIPTION OF THE DRAWING

Figure 1:
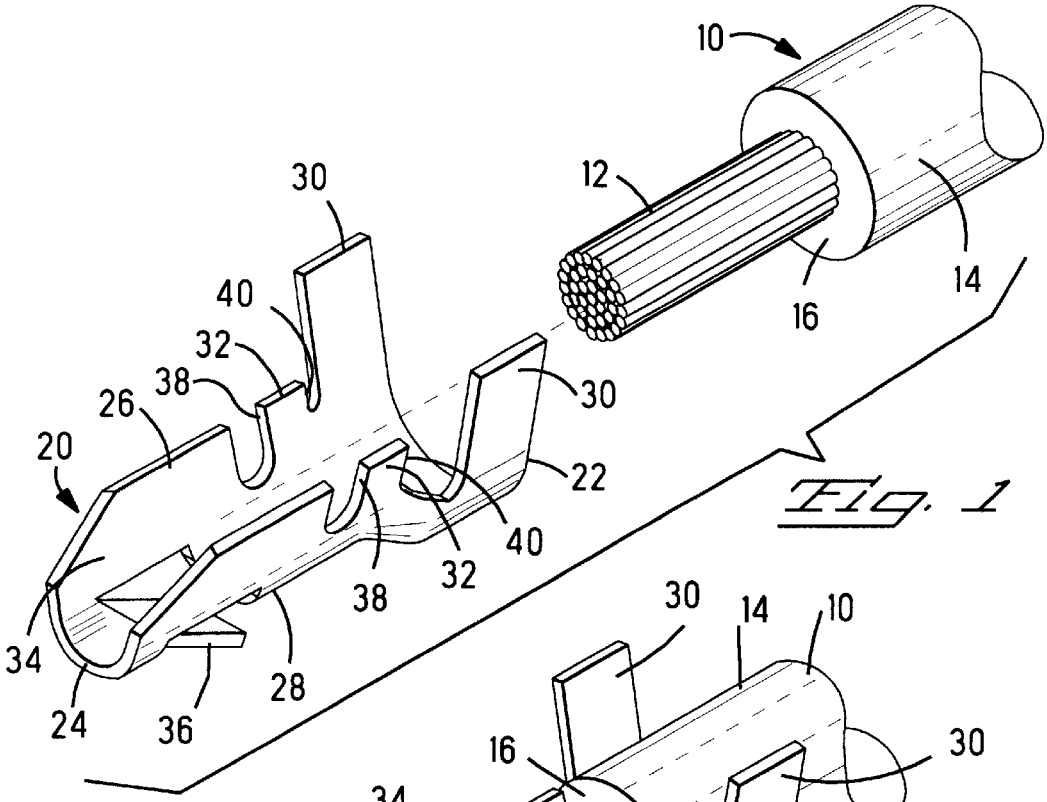
FIG. 1 is an exploded isometric view showing the contact terminal of the current invention and a conductor wire.

The invention is directed to a contact terminal 20 which is to be crimped onto a wire 10. The wire 10 includes inner conductors 12. The inner conductors may either be a solid conductor or a series of stranded conductive wires as is shown is FIG. 1, but will be referred to as conductors herein for simplicity. The conductors 12 are surrounded by an insulation or insulative jacket 14. Along the end of the wire 10 the insulation is removed thereby exposing the conductors 12 at a stripped wire end in order to provide a surface for terminating with the contact terminal 20. The removal of the insulation along the end creates a forwardly facing shoulder or jacket and 16 on the insulation.

The contact 20 has a rearward end 22, a forward end 24, a top end 26, and a base 28. The contact 20 is generally U-shaped and is open along the top end 26.

While an open barrel contact terminal is shown for example, it is understood by one skilled in the art that the invention can be practiced on a closed barrel contact terminal or a contact terminal having some other configuration.

Along the rearward end 22 are two arms 30 which extend upwardly from the base 28 along either side of the contact 20, the base and the arms being generally U-shaped. The arms 30 will provide the insulation crimp for the insulation on the wire.

Forward of the arms 30 is a stop section having two stop arms 32. The stop arms 32 extend upwardly from the base 28 and also are generally formed in a U-shape. The U-shape is generally smaller for the stop arms 32 than for the insulation crimping arms 30, that is, the stop arms 32 are generally closer together and shorter than the arms 30. The stop arms 32 each have a forwardly facing shoulder 38 and a rearwardly facing shoulder 40.

Forward of the stop arms is the crimping and contact section 34. The conductor crimping and contact section 34 includes a generally U-shaped barrel having upwardly extending arms on either side and a resilient latch 36 extending from the base 28 of the contact on the opposite side thereof from conductor crimping arms 26. FIG. 1 shows one representative embodiment of the crimping and contact section, but it should be understood that many different variations of the crimping and contact sections exist, they may be together or separate and the location and configuration of the latching arm may be varied. The representative embodiment shown has the crimping and contact section as one integral part, but they could be separate portions of the contact terminal.

Figure 2:
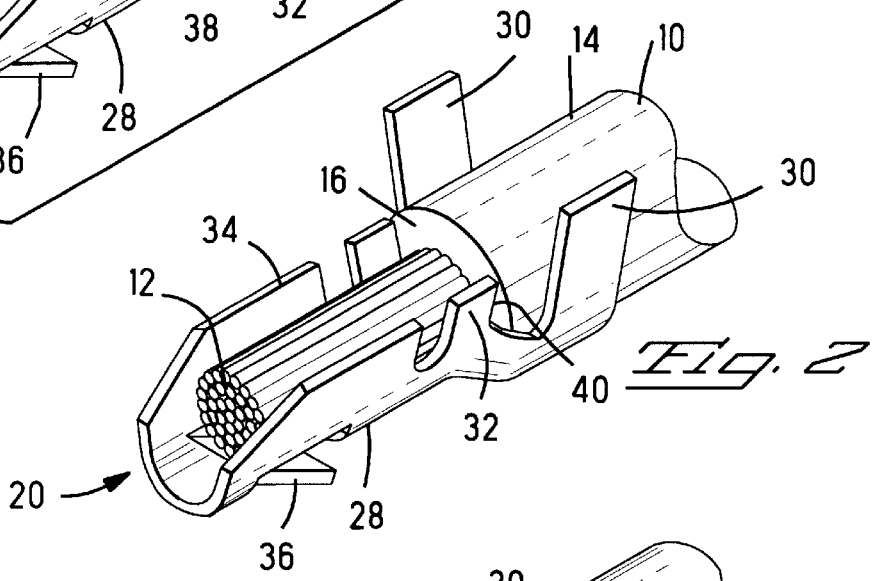
FIG. 2 is an isometric view showing the wire assembled with the contact terminal.

The wire 10 is received into the contact 20 as is shown in FIG. 2. The insulation 14 is received between the insulation arms 30 on the contact. The forwardly extending conductors 12 are received further from that point into the crimping and contact section 34 such that the conductors 12 are received both between the stop arms 32 and also between the arms of the crimping and contact sections. The stop arms 32 are closer to each other than the insulation crimping arms 30 thereby preventing the insulation 14 from being inserted further into the contact as is shown in FIG. 2. The rearwardly facing shoulder 40 of the stop arms 32 engage the forwardly facing shoulder 16 of the insulation 14 thereby preventing the wire 10 from being inserted further into the contact 20. The most forward end of the conductors 12 are received into the crimping and contact section 34 as is shown in FIG. 2, or alternatively, the conductors 12 may extend beyond the forward end 24 of the contact.

Figure 3:
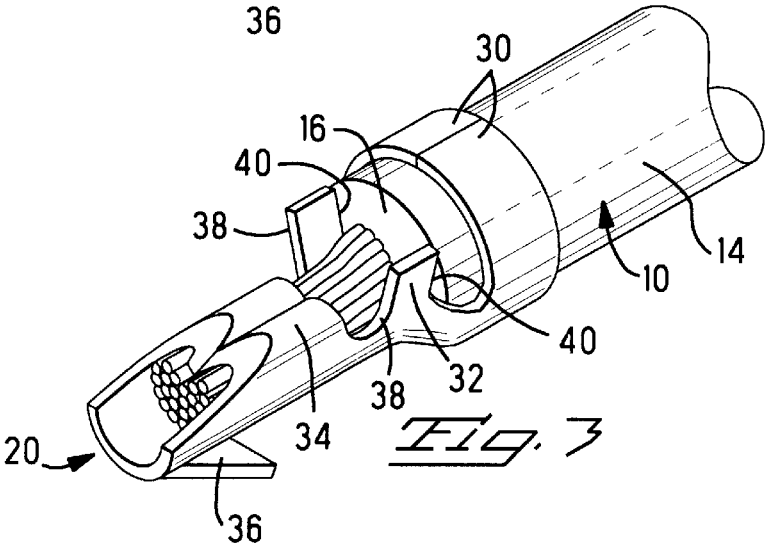
FIG. 3 is similar to FIG. 1 with the contact terminal crimped to the wire.

FIG. 3 illustrates the crimping of the contact terminal 20 to the wire 10. In the crimping and contact section, the upwardly extending conductor crimping arms 26 are crimped down and into the conductors 12 thereby forming a good electrical contact between the terminal and the conductors. The insulation crimping arms 30 are crimped down, simultaneously with arms 26 of conductor the crimping section, to secure the rearward end of the contact to the insulation 14 and to provide a strain relief for the wire 10. The insulation crimping arms 30 are being shown as being crimped in an abutting relationship; that is the end of the insulation crimping arms 30 abut each other after being crimped over the insulation. However, the crimping arms could also be overlapped or crimped in a different configuration depending on the size and shape of the wire and the mechanical requirements on the wire. The stop arms 32 are not crimped in this process, as is shown in FIG. 3. However, they can also be partially crimped to form a better connection between the wire 10 and the contact 20.

Figure 4:
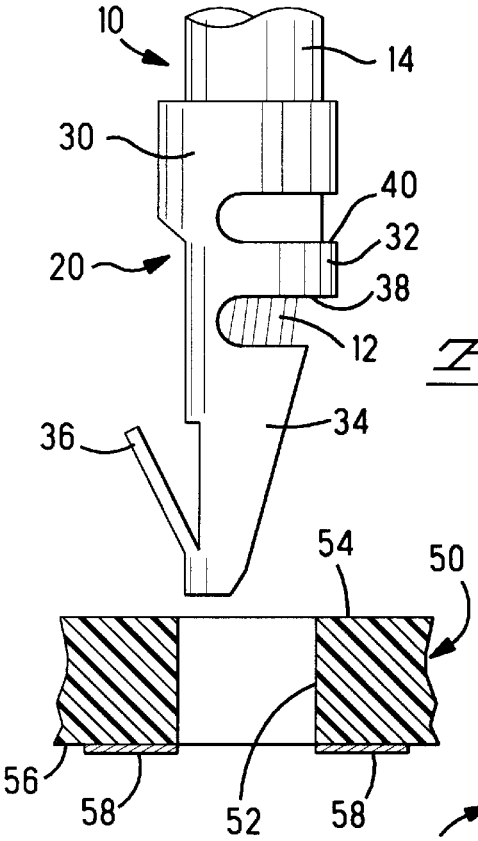
FIG. 4 is a cross sectional view showing the crimped contact terminal and a circuit board.

FIG. 4 shows the insertion of the contact terminal into a through hole 52 on a circuit board 50. The circuit board 50 has an upper surface 54 and a lower surface 56, the lower surface 56 having electrical traces 58 thereon. The contact terminal 20 is inserted from the upper surface 54 through a through hole 52 and extends through the lower surface of the circuit board 50.

The contact terminal 10 is inserted through the through hole 52 until the latching arms 36 is received along the lower surface 56 of circuit board 50. While being moved through the through hole 52, the latching arm 36 is flexed inwardly. As the latching arm 36 passes out of the through hole, the latching arm then resiles back to its original position thereby temporarily latching the contact terminal 20 to the circuit board 50. The forwardly facing shoulder 38 of the stop arm 32 abuts against the upper surface 54 of the circuit board thereby preventing the contact terminal from moving further through the circuit board in the insertion direction.

The contact terminal has now been positioned on the circuit board 50 to allow the contact terminal to be soldered to the circuit board and thereby provide electrical connections between conductors of the wire on the circuit board and the traces 58. The stop arm 32 has stopped the insulation 14 on the wire 10 at a certain point within the contact terminal. The other side of the stop arm 32 has prevented the terminals from inserting all the way through the circuit board 50 and has stopped the contact terminal at a designated position with respect to the circuit board, therefore the insulation 14 of the wire 10 is secured away from the circuit board and above the upper surface 54.

Figure 5:
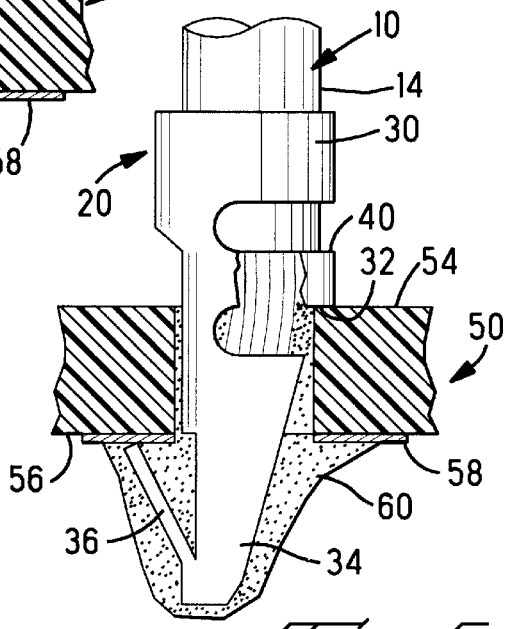
FIG. 5 is a cross sectional view showing the contact terminal secured to the circuit board.
Figure 6:
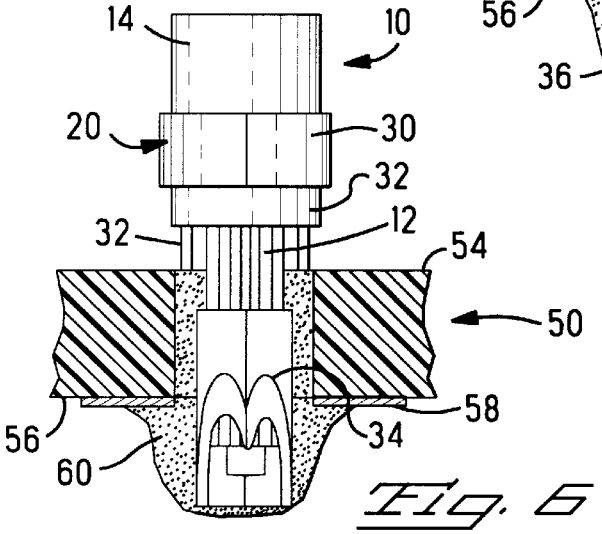
FIG. 6 is a cross sectional view of the contact and the circuit board showing the top of the contact terminal.

During soldering, the soldering material is heated and applied to the under surface of the circuit board at the point where the contact 20 extends from the circuit board. The heated solder 60 is a fluid and will therefore flow over the contact and into connection with the traces on the circuit board and also into the through hole as is shown in FIG. 5. If the heated solder comes into contact with the insulation 14 of the wire, the heated solder can cause problems with the insulation either in breaking it down or catching it on fire. Further, if the insulation is exposed to the heat source, the same problems can occur. Therefore, the use of the stop arm 32 in the terminal 20 prevents the insulation 14 from coming into contact with the circuit board 50. During the soldering process, the solder is maintained away from the insulation thereby preventing breakdown of the insulation from the heat of the solder.

One further problem that can exist is that if the insulation is held in close proximity to the circuit board, flux can be trapped between the insulation and the upper surface of the circuit board. Over time the trapped flux can cause corrosion of the conductors and subsequent mechanical problems from the corrosion. The current invention keeps the insulation above the surface of the circuit board. Because there is space between the insulation and the upper surface, the cleaning washes can remove the flux from that space. A longer lasting mechanical connection will therefore be formed.

The advantage of the invention is that the insulation is maintained away from the circuit board during the soldering process so that the insulation will not be damaged due to be exposed to heat. The contact terminal provides both an insulation stop and a circuit board stop which positions that insulation so that it is spaced away from the circuit board. The further advantage is that the contact terminal allows flux to be washed away from between the insulation and the circuit board thereby providing a longer lasting connection.

The contact terminal of the present invention and many of its attended advantages will be understood from the foregoing description. It is apparent that various changes may be made in the form of construction and arrangement of parts thereof without departing from the spirit or scope of the invention or sacrificing all of its material advantages.

I claim:

1. A contact terminal, comprising:

a body having a forward end and a rearward end, the body having an insulation crimping section along the rearward end, a conductor crimping section, and a latch member toward the forward end, a stop section being disposed along the body between the insulation crimping section and both the conductor crimping section and the latch member, the stop section having a forwardly facing shoulder and a rearwardly facing shoulder, the body being adapted to be crimped to a wire having an insulative jacket surrounding a conductor of a wire, the rearwardly facing shoulder providing a stop for an end of the insulative jacket adjacent a stripped end of the wire so that the insulative jacket is not received into the body forward of the stop section, the insulation crimping section being adapted to be secured to the insulative jacket and the conductor crimping section being adapted to be crimped to the conductor, the conductor crimping section being received through a hole in a circuit board to provide electrical connection therewith upon soldering, the circuit board having a first surface and a second surface, the latch member engaging the second surface and the forwardly facing shoulder engaging the first surface, thereby positioning the insulative jacket away from the circuit board during soldering to protect the insulative jacket from heat.

2. The contact terminal of claim 1, wherein the body has a base and the insulating crimping section is U-shaped and includes arms that are upstanding from the base, the conductor crimping section is U-shaped having second arms upstanding from the base, and the stop section is U-shaped having third arms upstanding from the base.

3. The contact terminal of claim 2, wherein the third arms of the stop section are closer to each other and extend upwardly from the base a less distance than the arms of the insulation crimping section.

4. The contact terminal of claim 1, wherein the latch member is a resilient latch arm.

5. The contact terminal of claim 2, wherein the latch member extends outwardly from the base of the contact in a direction opposite to the second arms of the conductor crimping section.

6. A contact terminal, comprising:

a body having a forward end, a rearward end, an insulation crimping section, and a conductor crimping section, a first stop member to engage an end of the insulative jacket adjacent a stripped end of a wire and prevent the insulative jacket from being inserted further forward into in the body, a second stop member to engage an upper surface of a circuit board and prevent the body from being inserted further forward into a through hole in the circuit board, the second stop member being further forward on the body than the first stop member and both the first and second stop members being positioned between the insulation crimping section and the conductor crimping section, wherein when the body is inserted into the through hole in the circuit board, the first and the second stop members maintain the insulative jacket of the wire spaced away from the circuit board thereby protecting the insulative jacket from exposure to heat during soldering.

7. The contact terminal of claim 6, wherein a latch member is disposed along the body, forward of the second stop member, the latch member providing a temporary retention of the body to the board prior to the soldering process.

8. The contact terminal of claim 7, wherein the latch member engages a lower surface on the circuit board on which electrical traces are disposed.

9. The contact terminal of claim 6, further comprising a stop arm, wherein the first stop member is a rearwardly facing shoulder on the stop arm and wherein the second stop member is a forwardly facing shoulder on the stop arm.

10. The contact terminal of claim 6, wherein the body has a base and the insulation crimping section includes U-shaped arms which are upstanding from the base, the conductor crimping section arm having second U-shaped arms upstanding from the base, and the stop arm being third U-shaped arms upstanding from the base.

11. The contact terminal of claim 10, wherein the third arms of the stop section are closer to each other and extend upwardly from the base a less distance than the arms of the insulation crimping section.

12. The contact terminal of claim 7, wherein the latch member is a resilient latch arm.

13. The contact terminal of claim 10, wherein the latch member extends outwardly from the base of the contact in a direction opposite to the second arms of the conductor crimping section.

14. An electrical connection of a contact terminal to an end of an insulated conductor, comprising:

said conductor having an insulative jacket therearound extending from a jacket end adjacent a stripped end portion, and said contact terminal including a body having a forward end and a rearward end, said body having an insulation crimping section along said rearward end, a conductor crimping section, and a latch member toward said forward end, a stop section being disposed along said body between said insulation crimping section and both said latch member and said conductor crimping section, said stop section having a forwardly facing shoulder and a rearwardly facing shoulder, said crimping section being crimped to said stripped end portion of said conductor and said insulation crimping section being crimped around an insulated portion of said conductor with said jacket end being rearwardly of said rearwardly facing shoulder so that said insulation is not received into said body forward of said stop arm, whereby when the body is received through a hole in a circuit board to provide electrical connection therewith, the circuit board having a first surface and a second surface, the latch member engages and latches against the second surface and the forwardly facing shoulder of said stop section engages the first surface, thereby positioning the insulative jacket away from the circuit board during soldering to protect the insulation from heat.

15. An electrical connection of a contact terminal to an end of an insulated conductor, comprising:

said conductor having an insulative jacket therearound extending from a jacket end adjacent a stripped end portion, and said contact terminal including a body having a forward end, a rearward end, an insulation crimping section, and a conductor crimping section, a first stop member to engage said jacket end and prevent the insulative jacket from being inserted further forward into in the body, a second stop member to engage an upper surface of a circuit board and prevent the body from being inserted further forward into a through hole in the circuit board, the second stop member being further forward on the body than the first stop member and both the first and second stop members being positioned between the insulation crimping section and the conductor crimping section, wherein when the body is inserted into the through hole in the circuit board, the first and the second stop members maintain the insulative jacket of the wire spaced away from the circuit board thereby protecting the insulative jacket from exposure to heat during soldering.

16. The connection of claim 15, wherein a latch member is disposed along the body forward of said second stop member and providing a temporary retention of said body to said board prior to the soldering process.

17. The connection of claim 15 wherein at least one stop arm extends laterally from said base and includes a rearwardly facing shoulder defining said first stop member and a forwardly facing shoulder defining said second stop member.

18. The connection of claim 15 wherein a pair of stop arms coextend laterally from said base and include rearwardly facing shoulders defining said first stop member and forwardly facing shoulders defining said second stop member.

* * * * *